United States Patent [19]

Rausch et al.

[11] 3,940,893

[45] Mar. 2, 1976

[54] BUILDING PANEL JOINT

[75] Inventors: Donald L. Rausch, Cedar Falls; Donald A. Jacque, Dunkerton, both of Iowa

[73] Assignee: R-J Industries, Inc., Waverly, Iowa

[22] Filed: Feb. 22, 1974

[21] Appl. No.: 444,746

[52] U.S. Cl. ..... 52/90; 52/468; 52/586

[51] Int. Cl.[2] ..... E04B 1/68

[58] Field of Search ..... 52/37, 586, 466, 467, 90, 52/468, 464, 277, 278

[56] References Cited

UNITED STATES PATENTS

| | | | |
|---|---|---|---|
| 3,646,716 | 3/1972 | Jenner | 52/90 X |
| 3,667,177 | 6/1972 | Biela | 52/278 |
| 3,685,222 | 8/1972 | Curtess | 52/586 X |
| 3,771,277 | 11/1973 | Rausch et al. | 52/586 X |

*Primary Examiner*—Ernest R. Purser
*Assistant Examiner*—Carl D. Friedman
*Attorney, Agent, or Firm*—Zarley, McKee, Thomte, Voorhees & Sease

[57] ABSTRACT

An A-frame home includes interconnected roof panels. The joint connection is at the apex of the abutting upper panel edges which includes abutting vertically disposed surfaces. Aligned horizontal slots are formed in the vertical surfaces and connect with enlarged cavities. The slots and cavities form an I-shaped passageway. An I-shaped connecting element is slidably positioned in the I-shaped passageway for locking the panels together. The upper edges of the panels are horizontal and flat while the top portion of the vertical abutting faces are slightly spaced apart to receive a rib extending downwardly from a cap. The rib includes laterally extending teeth for gripping the adjacent groove surfaces. A pair of shoulders oppositely disposed relatively to the rib extend downwardly from the cap for engagement with the top horizontal surface of the panels and downwardly extending flanges are provided on the outer edges of the cap wings and the flanges extend downwardly along the outer panel surfaces.

1 Claim, 3 Drawing Figures

BUILDING PANEL JOINT

Important to structures formed of panels is that they be quickly assembled or disassembled and this will depend a large part upon the connecting joints utilized.

The structural joint of this invention includes an I-shaped connecting element received in a correspondingly shaped passageway formed by oppositely extending slots in abutting faces of panels which in turn open into enlarged cavities. The connecting element is horizontally positioned and inserted into the passageway from one side or the other of the pair of panels. The connecting element may be of plastic or metal material and similarly the panels may include a metal frame in combination with a wood exterior.

Moisture is prevented from entering the joint by a cap being placed over the top. The cap includes a downwardly extending rib having teeth on it and the rib is received in a groove formed by spaced apart abutting face portions on the adjacent joint surfaces. The cap can be snapped into and out of position and is formed from plastic material.

It is understood that the joint of this invention while shown in a 60° peak joint for A-frame homes can nevertheless be used in an infinite variety of fastening situations.

This invention consists in the construction, arrangements and combination of the various parts of the device, whereby the objects contemplated are attained as hereinafter more fully set forth, specifically pointed out in the claims, and illustrated in the accompanying drawings in which:

Figure 1:
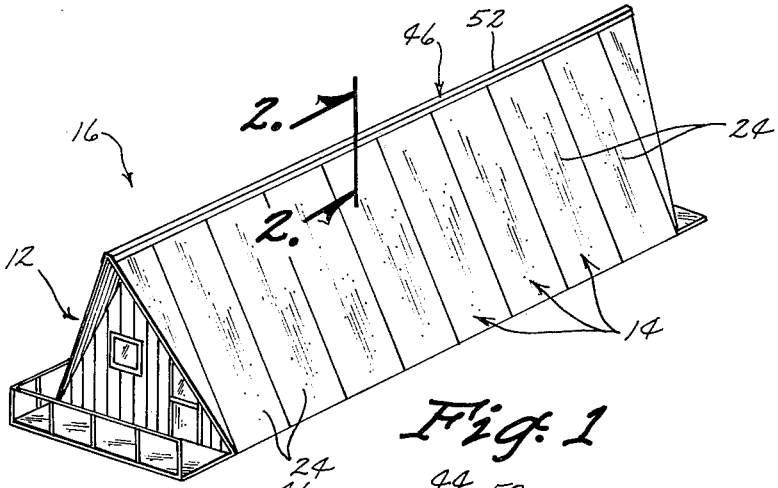
FIG. 1 is a perspective view of an A-frame home employing panel construction wherein the panels are interconnected by the joint of this invention.
Figure 2:
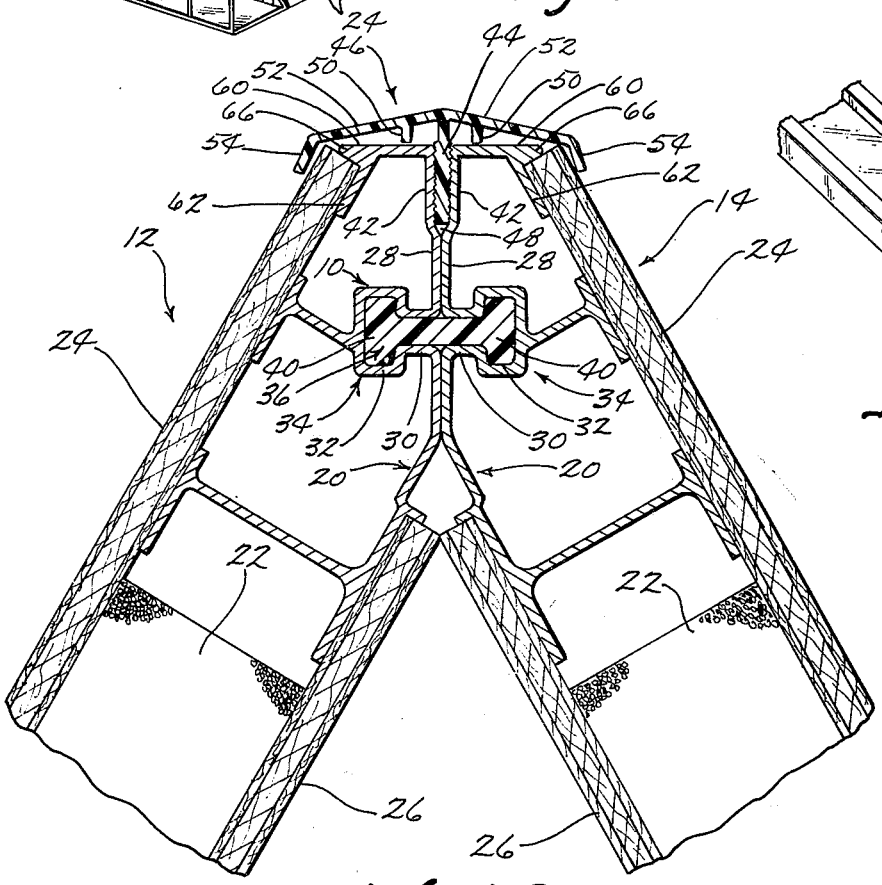
FIG. 2 is a cross section of view taken along line 2 — 2 in FIG. 1 and showing specifically the joint of this invention.

The structural joint of this invention is referred to in FIG. 2 generally by the reference numeral 10 and is seen connecting together a pair of roof panels 12 and 14 in an A-frame home 16 seen in FIG. 1.

Each of the panels include aluminum frames 20 which are filled with expanded foam core installation material 22 enclosed by outer plywood sheets 24 and 26.

Figure 3:
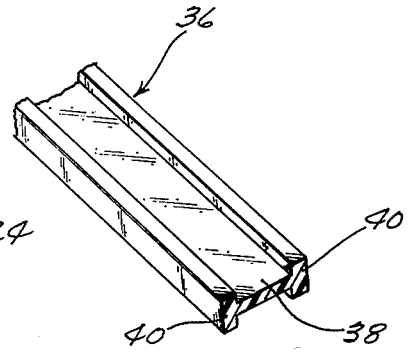
FIG. 3 is a fragmentary perspective view of the connecting element of the joint of FIG. 2.

The aluminum frame 20 of each panel includes vertically disposed abutting faces 28 having slots 30 formed therein and running the width of the panels which in turn merge into enlarged cavities 32 to form an I-shaped passageway 34. A correspondingly shaped I-shaped connecting element 36 is seen in FIGS. 2 and 3 and is horizontally disposed and inserted into the passageway 34 from either end of the assembled panels 12 and 14. The I-shaped connecting element 36 includes a stem portion 38 and rectangular in shape opposite end portions 40. The connecting element may be fabricated from plastic preferably although metal can also be used.

The abutting faces 28 include portions 42 which are spaced apart and include serrations for engagement with corresponding serrations on a downwardly extending rib 44 carried on a cap 46. The spaced apart portions 42 form a groove 48 filled by the rib 44. Also extending downwardly from the cap are shoulders 50. The cap includes outwardly extending wings 52 which terminate in downwardly extending flanges 54 positioned outwardly of and over the adjacent outer surfaces of the panels 12 and 14 thereby completely protecting the joint from moisture. The wings 52 of the cap 46 taper outwardly and downwardly thereby deflecting the rain and the downwardly extending shoulders 50 maintain this angle. The metal frame 20 of the panels include horizontal wall portion 60 against which the shoulders 50 bear. The outer edges of the wall portion terminate in a downwardly and outwardly extending portion 62 against which the upper end of the plywood sheet 24 bears. Shoulders 66 are provided at the corner of the wall portions 60 and 62 and limit movement of the plywood sheets 24.

In operation it is seen that roof panels 12 and 14 are positioned as seen in FIG. 2 with the slots 30 in alignment such that the I-shaped connecting element 36 can be inserted and thereby locking the panels together. Next and lastly the cap 46 is placed on top with the rib 44 extending down into the groove 48. The cap is locked in place by the interaction of the teeth and serrations on the abutting faces. Should it be necessary or desirable to disassemble the building this can be accomplished by removal of the I-shaped element 36 and removal of the cap 46.

We claim:

1. An A-frame roof structure structural joint comprising, a pair of upstanding roof panels positioned to form an A and having abutting vertically disposed surfaces at their apex, said vertical surfaces having aligned horizontal slots which connect with enlarged cavities to form an I-shaped passageway, an I-shaped connecting element slidably positioned in the I-shaped passageway for detachably locking said panels together, said abutting faces including spaced apart portions above said I-shaped passageway which form a groove which opens upwardly, said groove having sidewalls including serrations, said panels having top end edges which are horizontal and flat and merge with said groove and with said outer surfaces on said panels extending downwardly and outwardly, a cap positioned on said top end edges, said cap including a downwardly extending rib received in said groove and said rib including serrations engaging the serrations of said groove sidewalls, said cap having a horizontal portion including wing portions on opposite sides of said rib and said wing portions slope downwardly and outwardly to the outside surfaces of said panels where said wings merge into sidewall portions which extend downwardly along said outside surfaces of said panels and downwardly extending shoulder means are provided on said cap on opposite sides of said rib and engage the top end edges of said panel to limit movement of said wing portions towards said panel end edges.

* * * * *